US006896563B1

(12) United States Patent
Dickson

(10) Patent No.: US 6,896,563 B1
(45) Date of Patent: May 24, 2005

(54) JOYSTICK STEERING APPARATUS FOR WATERCRAFT

(76) Inventor: Trevor Alan Dickson, 238 Kenmure Road, Dunedin (NZ)

( * ) Notice: Subject to any disclaimer, the term of this patent is extended or adjusted under 35 U.S.C. 154(b) by 0 days.

(21) Appl. No.: 10/768,324

(22) Filed: Jan. 30, 2004

(51) Int. Cl.[7] ..... B63H 11/107
(52) U.S. Cl. ..... 440/40; 114/144 R
(58) Field of Search ..... 440/40

(56) References Cited

U.S. PATENT DOCUMENTS

| | | | |
|---|---|---|---|
| 1,403,318 | A | 1/1922 | Hansen |
| 1,860,173 | A | 5/1932 | Cotstad |
| 2,402,724 | A | 6/1946 | Bidwell |
| 3,040,697 | A | 6/1962 | Federico et al. |
| 3,085,447 | A | 4/1963 | Shay |
| 3,111,105 | A | 11/1963 | Bentkowsky et al. |
| 3,350,956 | A | 11/1967 | Monge |
| 3,386,308 | A | 6/1968 | Butler |
| 3,561,280 | A | 2/1971 | MacPhee et al. |
| 3,701,288 | A | 10/1972 | Jordan |
| 3,854,380 | A | 12/1974 | Casey |
| 4,173,937 | A | 11/1979 | Kulischenko et al. |
| 4,327,658 | A | 5/1982 | Kulischenko |
| 4,414,438 | A | 11/1983 | Maier et al. |
| 4,417,879 | A | 11/1983 | Kulischenko |
| 4,519,335 | A | 5/1985 | Krautkremer et al. |
| 4,691,659 | A | 9/1987 | Ito et al. |
| 4,942,838 | A | 7/1990 | Boyer et al. |
| 4,962,717 | A | 10/1990 | Tsumiyama |
| 5,129,846 | A | 7/1992 | Dimijian |
| 5,375,551 | A | 12/1994 | Lunter et al. |
| 6,230,642 | B1 | 5/2001 | McKenney et al. |

OTHER PUBLICATIONS

Hamilton Jet, How a Waterjet Works Web Page, Web Page, 2001, http://www.hamjet.co.nz/index.cfm/The_Hamilton_Waterjet/How_a_Waterjet_Works.html.

*Primary Examiner*—Jesus D. Sotelo
(74) *Attorney, Agent, or Firm*—Harleston Law Firm, LLC; Kathleen M. Harleston

(57) ABSTRACT

A joystick apparatus for steering a waterjet propelled watercraft includes: (a) a joystick comprising at least three movably interconnected swinging arms, with a first and third one of the swinging arms being generally vertically oriented, and a second one of the swinging arms being generally horizontally oriented; (b) a mechanical housing supporting the joystick, which includes a generally horizontally oriented housing plate affixed to the watercraft, the joystick passing through an aperture in the housing plate and being swivelable on the housing plate; and (c) at least one mechanism movably connecting the joystick apparatus to an outdrive of the watercraft; wherein the joystick has at least one forward position for putting the watercraft on plane, at least one right steering position for steering the watercraft in a rightward direction, and at least one left steering position for steering the watercraft in a leftward direction.

22 Claims, 10 Drawing Sheets

JOYSTICK STEERING APPARATUS FOR WATERCRAFT

BACKGROUND OF THE INVENTION

1. Technical Field

The present invention relates generally to an apparatus including a joystick for steering a small watercraft having a jet drive engine and an outdrive.

2. Background Information

There are many different types of watercraft steering apparatus, each of which includes a steering device and a marine propulsion device. Examples of steering devices include rotary steering devices and tiller handles for rotating and holding outboard motors in different positions. Examples of marine propulsion devices include stern drives, outboard motors, shafted propellers, surface drives, and waterjets.

A waterjet is normally affixed to the bottom of boat's hull and rearwardly discharges a stream of high velocity water to impel a boat forward. Water, traveling at the speed of the boat, enters an intake and continues onto a pumping unit. Within the pumping unit, a spinning impeller, powered by the boat's engine, increases the pressure of the water. The water then exits the waterjet through a nozzle as a high velocity stream, which drives the boat forward. The direction of the high velocity water stream from the waterjet determines the direction of propulsion of the boat. A boat driver operates a rotary steering device or the like to manipulate the direction of the high velocity water stream.

A waterjet is in many ways superior to other types of marine propulsion devices. It imparts superior maneuverability to a boat, and is efficient and easy to install. Additionally, a waterjet has a simple design, low drag, and a shallow draft. It is easy to maintain, smooth and quiet, and does not endanger people in the water like an exposed propeller would. Lastly, a waterjet maximizes the life of an engine, since its impeller is matched to the boat's engine power, and the waterjet will not overload the boat's engine. A watercraft with a waterjet propulsion device is therefore highly desirable.

Unfortunately, rotary steering systems commonly used in waterjet propelled watercraft, such as leisure-type powerboats, typically have a steering column that extends between a steering wheel and a mechanical housing. Rotary steering systems typically have a completely enclosed mechanical housing, which cannot be readily opened for servicing. A need therefore exists for a steering system that is easy to service.

Like a steering wheel in an automobile, installing a steering wheel in a waterjet propelled watercraft is popular because its use is generally intuitive. Although popular, steering wheels rely on converting rotational movement to linear movement. A waterjet requires application of a linear force and linear movement to effect steering. Devices for achieving this may be, for example, a rack and pinion drive. One of the disadvantages of having to convert rotary motion into linear motion is that the apparatus generally required for this purpose is relatively expensive to manufacture. For example, worm gear drives or rack and pinion drives require many machined components.

Another disadvantage relates to the steering rate, that is, the amount of rotation of the waterjet for a given number of degrees of rotation of the steering wheel. A steering apparatus using a worm drive may require several revolutions of the steering wheel to provide a relatively short output movement, thus making it unsuitable for applications requiring fast steering response such as racing.

Yet another disadvantage of the prior art steering apparatus relates to its size and weight. Such systems are generally too heavy and bulky to be useful in, for example, a personal watercraft.

BRIEF SUMMARY OF THE INVENTION

The present invention includes a joystick apparatus for steering a watercraft having a waterjet for boat propulsion, which includes:

(a) a joystick with at least three movably interconnected swinging arms, a first and third one of the swinging arms being generally vertically oriented, and a second one of the swinging arms being generally horizontally oriented;

(b) a mechanical housing supporting the joystick, the mechanical housing comprising a generally horizontally oriented housing plate affixed to the watercraft, the joystick passing through an aperture in the housing plate and being swivelable on the housing plate; and (c) at least one mechanism movably connecting the joystick apparatus to an outdrive of the watercraft;

wherein the joystick has at least one forward position for putting the watercraft on plane, at least one alternate, right steering position for steering the watercraft in a rightward direction, and at least one alternate, left steering position for steering the watercraft in a leftward direction.

Also included herein is a steering apparatus for a watercraft with a jet drive engine, comprising:

(a) a joystick apparatus comprising a joystick and a mechanical housing supporting the joystick, the joystick comprising at least three movably interconnected swinging arms, with a first and third one of the swinging arms being generally vertically oriented and connected end to end, and a second one of the swinging arms being generally horizontally oriented;

(b) an outdrive comprising a movable rear nozzle, and (c) at least one cable mechanism operably connecting the joystick apparatus and the nozzle;

wherein movement of the joystick causes the nozzle to move a corresponding distance, and, when the watercraft engine is on and water is passing through the outdrive, this movement of the nozzle alters the direction of travel of the watercraft.

The present invention provides a watercraft steering apparatus with a joystick for maneuvering a waterjet propulsion mechanism, which overcomes many of the problems of currently available rotary steering devices, and provides the public with a viable choice. The joystick steering apparatus of the present invention is relatively small in size, light in weight, and relatively easy and inexpensive to manufacture. It is also very easy to adjust and service. With this relatively simple steering apparatus, which is not hydraulic and does not require electricity, a small watercraft accommodating one to three persons responds quickly to the driver's directions. Only a single component is necessary for pulling the boat "out of the hole", putting the boat on plane, and steering right and left, in contrast with commonly available steering devices. Importantly, the present apparatus can be used with one hand, leaving the driver's other hand free to attend to other tasks. The joystick is positioned so that it is easy to grasp for long periods without strain on the driver's arm, and there is no steering wheel blocking the driver's line of sight. In short, this steering apparatus is quite responsive and a joy to use.

Also included herein is a method for steering a waterjet propelled watercraft with one hand, comprising the steps of:

(a) depressing a throttle trigger;

(b) pushing the joystick forward with the same hand to bring the watercraft substantially on plane;

(c) allowing the joystick to return to a generally vertical position once the watercraft is substantially on plane;

(d) pushing the joystick to a position that is right or left of the generally vertical position to steer the watercraft in a rightward or leftward direction, respectively; and (e) allowing the joystick to return to the generally vertical position once a right or left turn is achieved.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
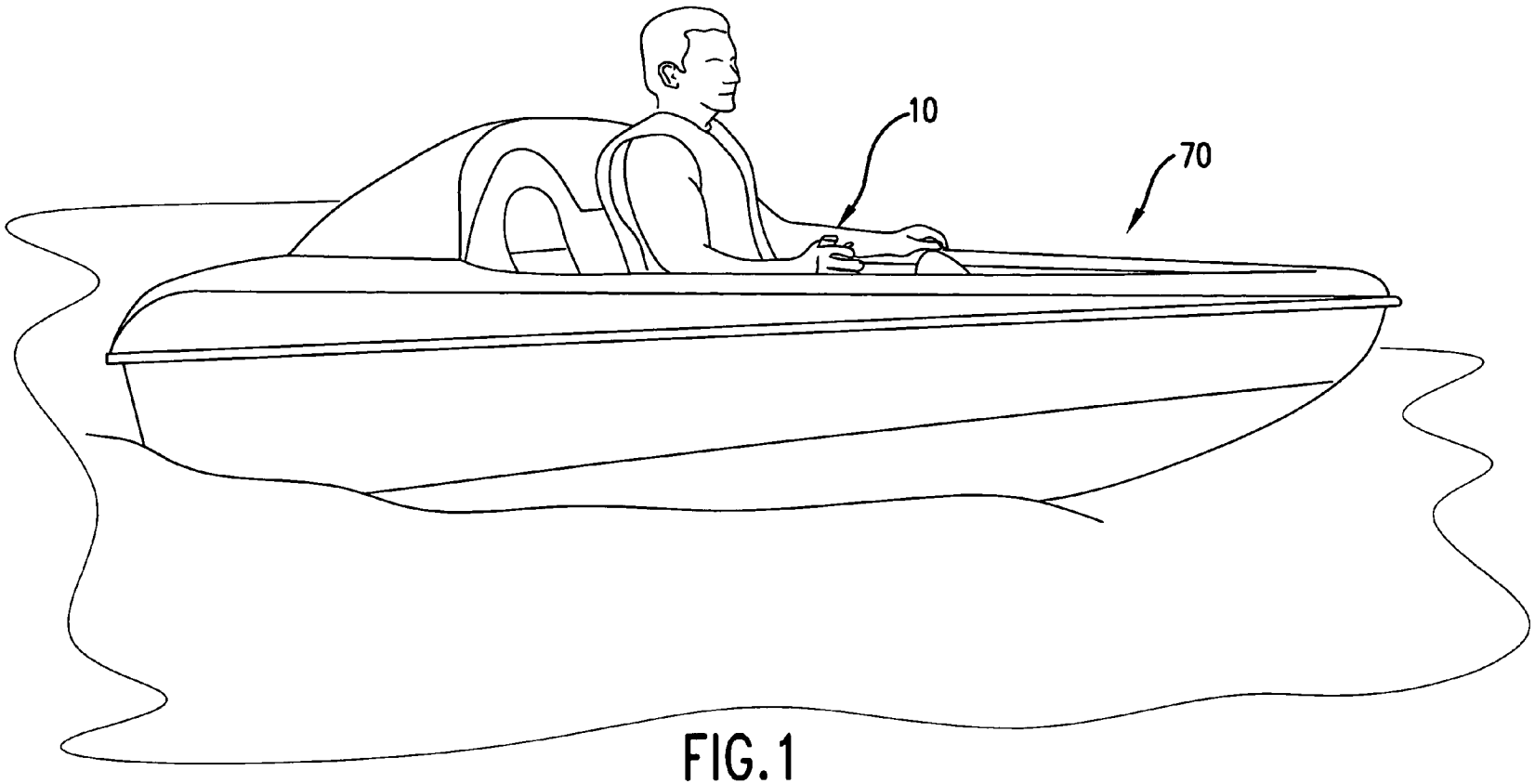
FIG. 1 shows a perspective view of a two-seat watercraft employing a joystick steering apparatus according to the present invention.

In the following description, like reference characters designate like or corresponding parts throughout the several views. Also, in the following description, it is to be understood that such terms as "front," "back," "within," and the like are words of convenience and are not to be construed as limiting terms. Referring in more detail to the drawings, the invention will now be described.

Referring to FIG. 1, the watercraft steering apparatus 10 of the present invention is for use on a small watercraft 70 driven by a marine jet engine. By "small watercraft" is meant a marine vessel less than about 18 feet in length or weighing less than about 800 pounds. The present invention is most preferably employed in a boat between about four and ten feet in length, and weighing less than about 500 pounds, which accommodates one, two, or three people and has a waterjet propulsion mechanism.

Figure 2:
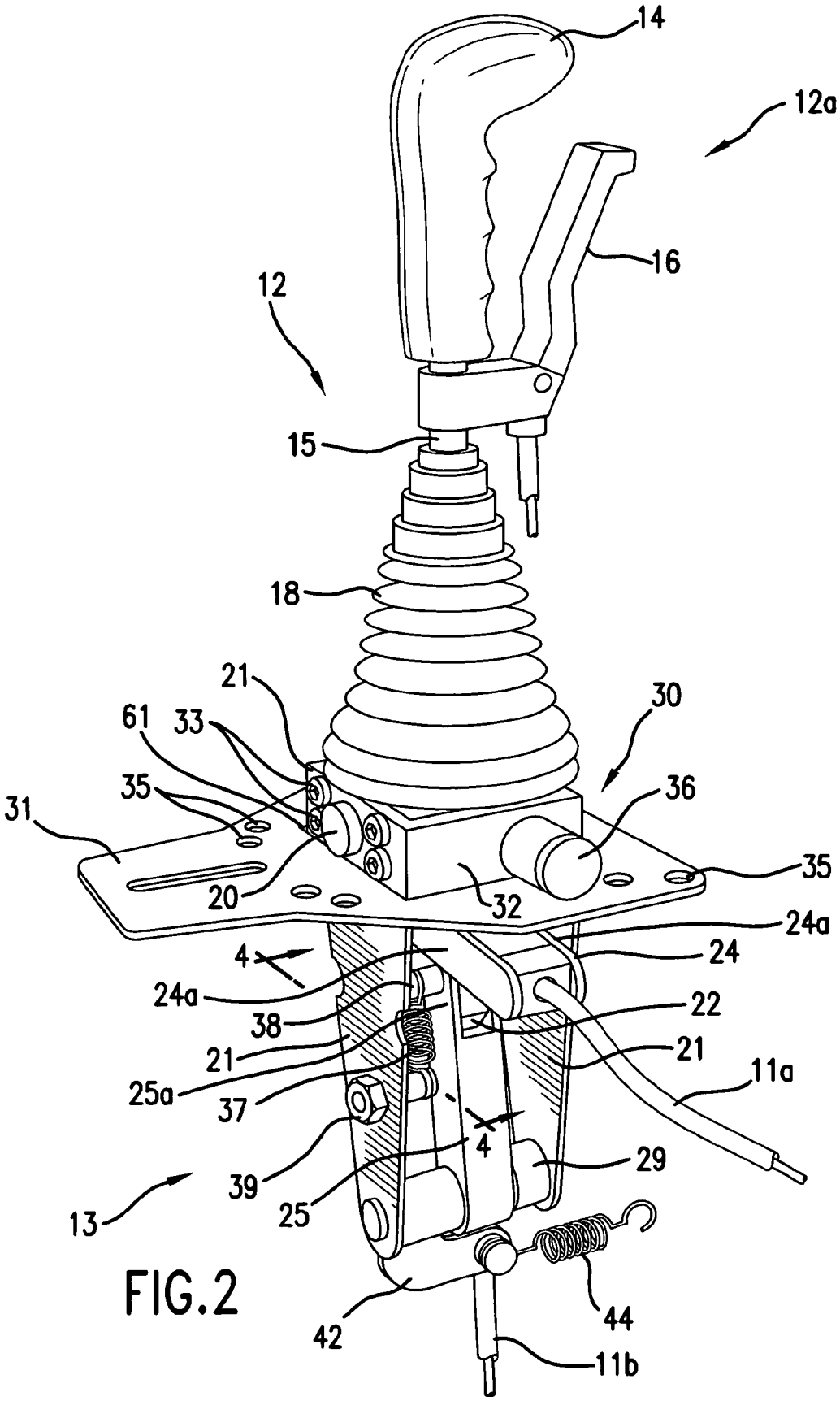
FIG. 2 is a perspective view of a joystick apparatus according to the present invention.
Figure 3A:
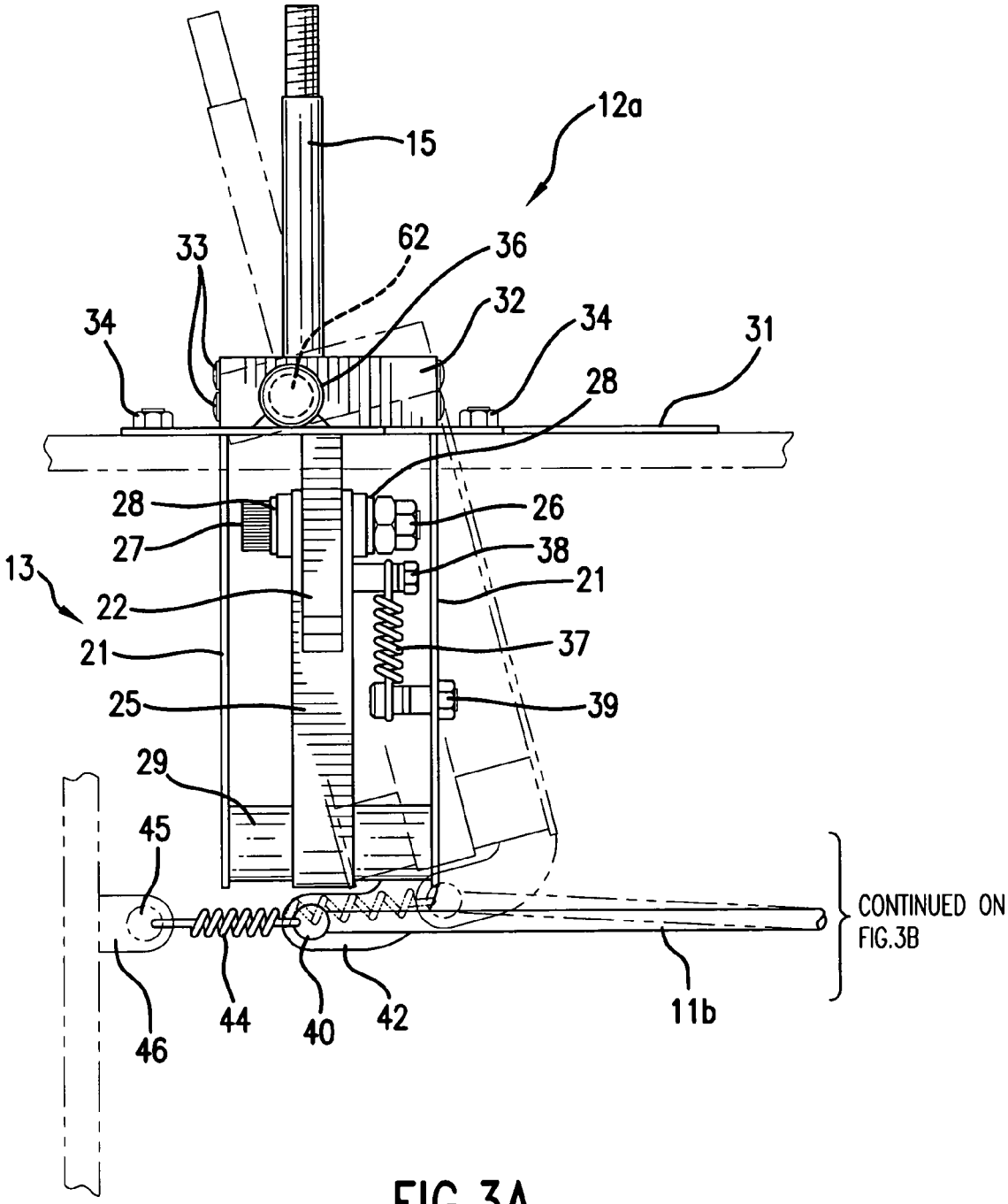
FIG. 3A is a side view of the joystick apparatus according to FIG. 2.
Figure 3B:
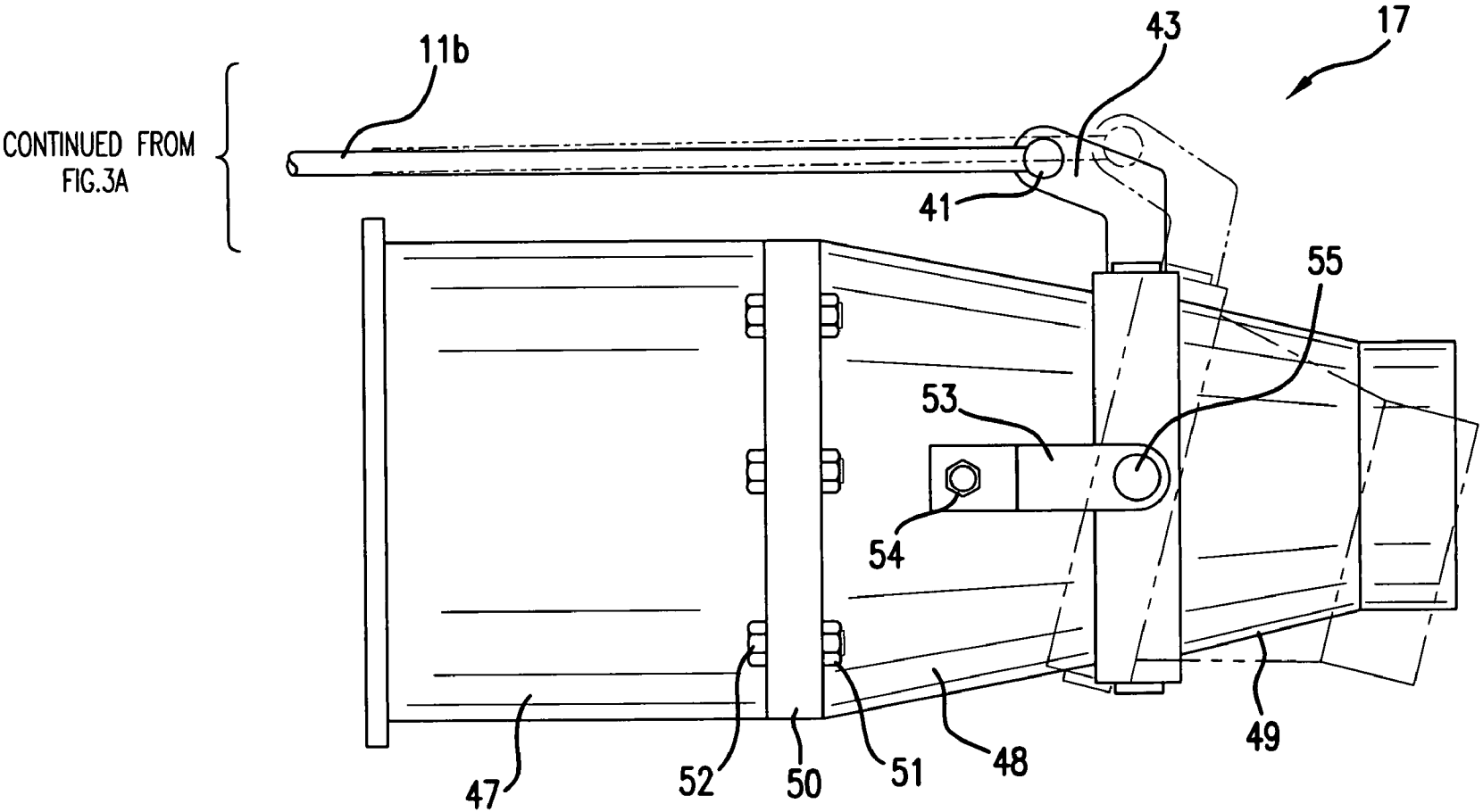
FIG. 3B is a side elevational view of an outdrive of a watercraft steering apparatus according to the present invention.

Turning to FIGS. 2 and 3, the watercraft steering apparatus 10 is comprised of a joystick apparatus 12*a*, an outdrive 17 under the watercraft, and at least one mechanism 11 for operably connecting the two, so that movement of the joystick causes a nozzle 49 of the outdrive to move a corresponding distance. When the watercraft engine is on and water is passing through the outdrive 17, this movement of the nozzle 49 alters the direction of travel of the watercraft 70. As shown in FIGS. 2 and 3, the joystick apparatus 12*a* comprises a joystick 12 and a mechanical housing 13 supporting the joystick 12. The mechanism connecting the joystick apparatus and the outdrive is preferably at least one, and most preferably two, push-pull cables 11. In the preferred embodiment depicted in FIGS. 2 and 3, these two push-pull cables are a direction cable 11*a* and a plane cable 11*b*, which are each movably connected at one end to a particular section of the joystick apparatus 12*a* (see FIGS. 2 and 3A), and at an opposite end to the nozzle 49 of the outdrive 17 (see FIG. 3B).

As shown in FIGS. 2 and 3A, the generally elongate, relatively straight joystick 12 is comprised of a hand grip 14 connected to a top portion of a steering arm 15. A throttle trigger 16 is attached to the steering arm 15 just below the level of the hand grip 14. The throttle trigger 16 extends in an upward direction close to the hand grip 14 to facilitate grasping by one or more fingers of the same hand. The hand grip 14 may be cushioned or molded, as shown in FIG. 2, to better fit the hand of the watercraft driver. The hand grip portion of the joystick preferably screws onto a correspondingly threaded end of the steering arm. A bottom portion of the steering arm 15 extends through a conical rubber boot 18 into the mechanical housing 13. The joystick 12 is positioned in a center console, where it is accessible to the driver. The bottom of the rubber boot 18 rests above the console. The majority of the mechanical housing 13 is incorporated into the console and the bottom of the boat, where it is hidden from view for protection from water and aesthetic reasons. The mechanical housing is preferably made of rust proof stainless steel.

Figure 4A:
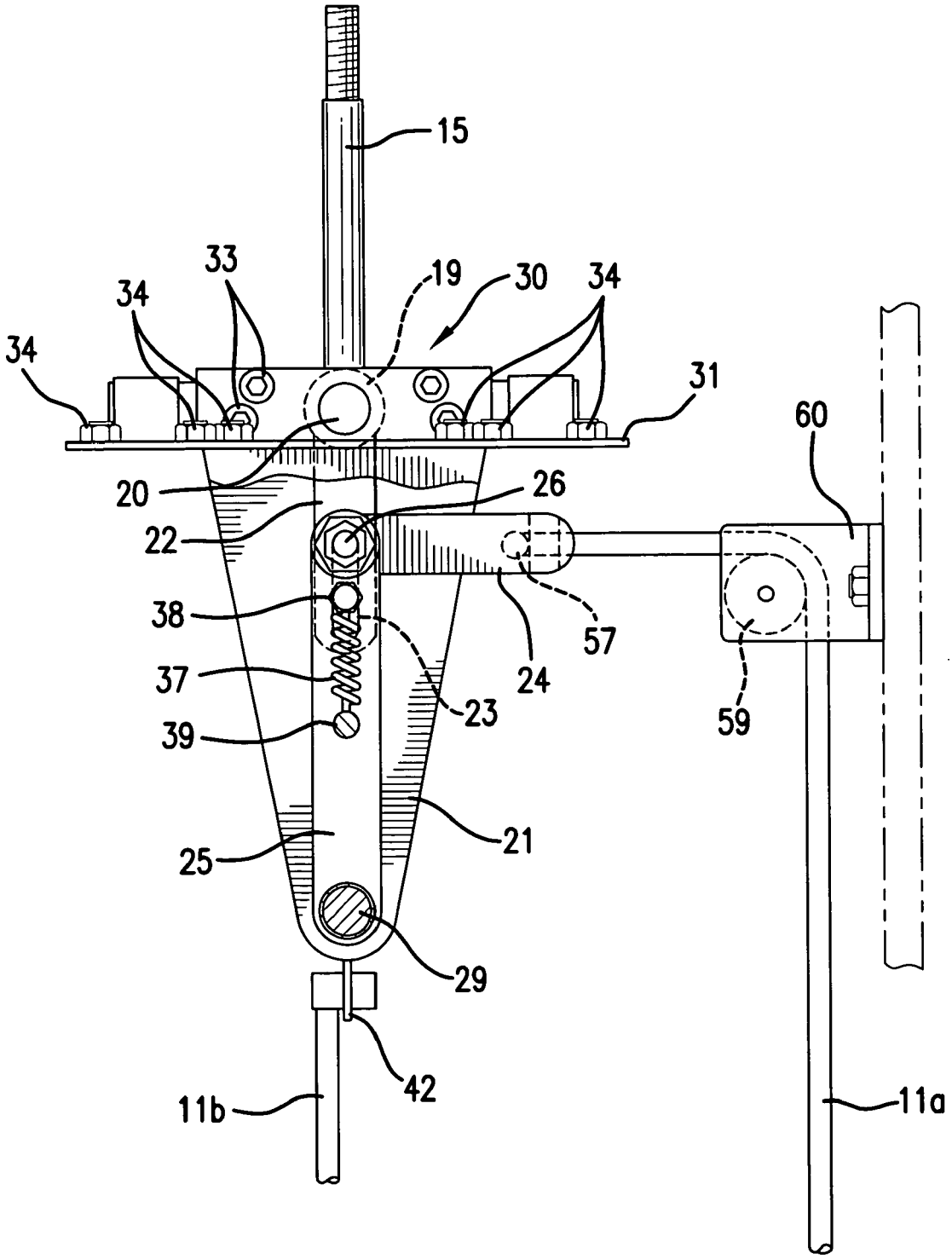
FIG. 4A is a front view of a joystick apparatus according to FIG. 2, with a first side of a mechanical housing of the joystick apparatus having been removed.

Referring to FIGS. 2 and 4A, a pivot mechanism between the steering arm above a well 30 of the mechanical housing 13 and the first swinging arm 22 below the well allows for pivoting the steering arm 15 and the first swinging arm within the well. The pivot mechanism includes a cylindrical pivot rod 19 within the mechanical housing 13, which is connected to a bottom portion of the steering arm 15. The pivot rod 19 is hollow and encloses a cylindrical first rod 20, which is supported by two matching, opposite first sides 21 of the mechanical housing 13. Both the pivot rod 19 and the first rod 20 are generally cylindrical in shape and transversely oriented to the steering arm 15. The cylindrical pivot rod 19 rotates on the first rod 20 such that the steering arm 15 pivots from a generally upright, vertical, central position, shown in FIG. 4A, to a position to the left of the vertical position, shown in FIG. 4E, and a position to the right of the vertical position, shown in FIG. 4C.

Within the mechanical housing, a first swinging arm 22 is connected to the pivot rod 19 diametrically opposite from the steering arm 15 such that the first swinging arm 22 is substantially transversely oriented to the pivot rod 19 and substantially longitudinally oriented to the steering arm 15

(see FIGS. 2 and 4A). The end of the first swinging arm 22 opposite the pivot rod 19 comprises an elongate slot 23 (see FIG. 4A).

Continuing with FIGS. 2 and 4A, the joystick apparatus 12*a* further comprises a generally horizontally oriented second swinging arm 24 and a generally vertically oriented third swinging arm 25 within the mechanical housing 13. The first and third swinging arms 22, 25 are substantially connected end to end. An upper portion of the third swinging arm 25 is divided into two branches that closely straddle opposite sides of a bottom portion of the first swinging arm 22, and the second swinging arm 24 is comprised of two branches that straddle the upper ends of the two branches of the third swinging arm 25 where they straddle the first swinging arm 22. The three swinging arms 22, 24, 25 are interconnected and interact so that leftward movement of the joystick 12 (see FIG. 4E) effects leftward movement of the outdrive 17 (see FIG. 4F), and rightward movement of the joystick 12 (see FIG. 4C) effects rightward movement of the outdrive 17 (see FIG. 4D). The bottom portion of the first swinging arm 22 is pivotally connected by a connection means 26, such as a bolt, extending through the elongate slot 23, through holes in the ends of the branches of the second swinging arm 24 and the third swinging arm 25. Preferably, the connection means 26 is a bolt (or rod) that extends through the elongate slot 23, and the holes (not shown) in the second swinging arm 24 and the third swinging arm 25. Two nuts 27, and optionally washers 28, threaded on the ends of the bolt 26 secure the bolt. Importantly, the elongate slot 23 controls the distance that the third swinging arm 24 pivots about the first swinging arm 22. The second and third swinging arms are also branched, so that when the joystick is pushed right or left, the lower end of the first swinging arm 22 swings between the two branches of the third swinging arm 24, as well as the second swinging arm 24, rather than going off center; therefore, right and left turns of the watercraft will be even.

A bottom end of the third swinging arm 25 is pivotally connected to a second pivot rod 29, which is supported by the first sides 21 of the mechanical housing 13. The third swinging arm 25 pivots on the second pivot rod 29 from an upright position, shown in FIG. 4A, to positions to the leftward, shown in FIG. 4C, and rightward, shown in FIG. 4E, of the upright position. Thus, there are three different pivotal connections within the mechanical housing 13. A first pivotal connection exists between the pivot rod 19 and the first rod 20. A second set of pivotal connections exists between the three swinging arms 22, 24, 25. A third pivotal connection exists between the third swinging arm 25 and the second pivot rod 29.

Referring back to FIG. 2, the bottom of the rubber boot 18 rests on a well 30 of the mechanical housing 13. The joystick extends into and through the well. The well 30 is formed by the first sides 21 of the mechanical housing 13, which extend upwardly through a rectangularly shaped housing plate aperture 61 in a housing plate 31, and two, shorter second sides 32 of the mechanical housing 13, which also extend through the housing plate aperture 61. The first sides 21 are substantially perpendicularly oriented to the second sides 32, so that the well 30 is generally rectangular in shape. (Herein, "rectangular" is meant to include square.) The first and second sides 21, 32 are coupled together by any suitable means, for example, by welding, riveting, or bolts. Preferably, the first and second sides 21, 32 are coupled by first bolts 33 inserted through holes in the sides 21, 32. The housing plate 31, which is preferably made of stainless steel, is bolted to the boat deck by suitable means, preferably by second bolts 34 inserted through bolt apertures 35 in the housing plate 31.

As depicted in FIG. 3A, two opposite pins 62 protrude substantially perpendicularly from the second sides 32 away from the center of the well 30. Here, the two pins fit snugly within two opposite, matching pin holders 36 attached to the housing plate 31. The pins 62 are rotatable in the pin holders, which support the weight of the joystick on the housing plate 31. The pins 62 allow the rest of the joystick apparatus to rock back and forth within the well 30 on the housing plate. The housing plate is attached to the boat deck.

In the preferred embodiment shown in FIG. 4A, a first coil spring 37 resists movement of the third swinging arm 25 from its upright position. The first coil spring 37 is attenuated between a first spring bolt 38 on the third swinging arm 25 and a second spring bolt 39. The first spring bolt 38 extends transversely through the third swinging arm 25 directly below the connection means 26. The second spring bolt 39 extends transversely through a first side 21 of mechanical housing 13 directly above the second rod 29.

Figure 4B:
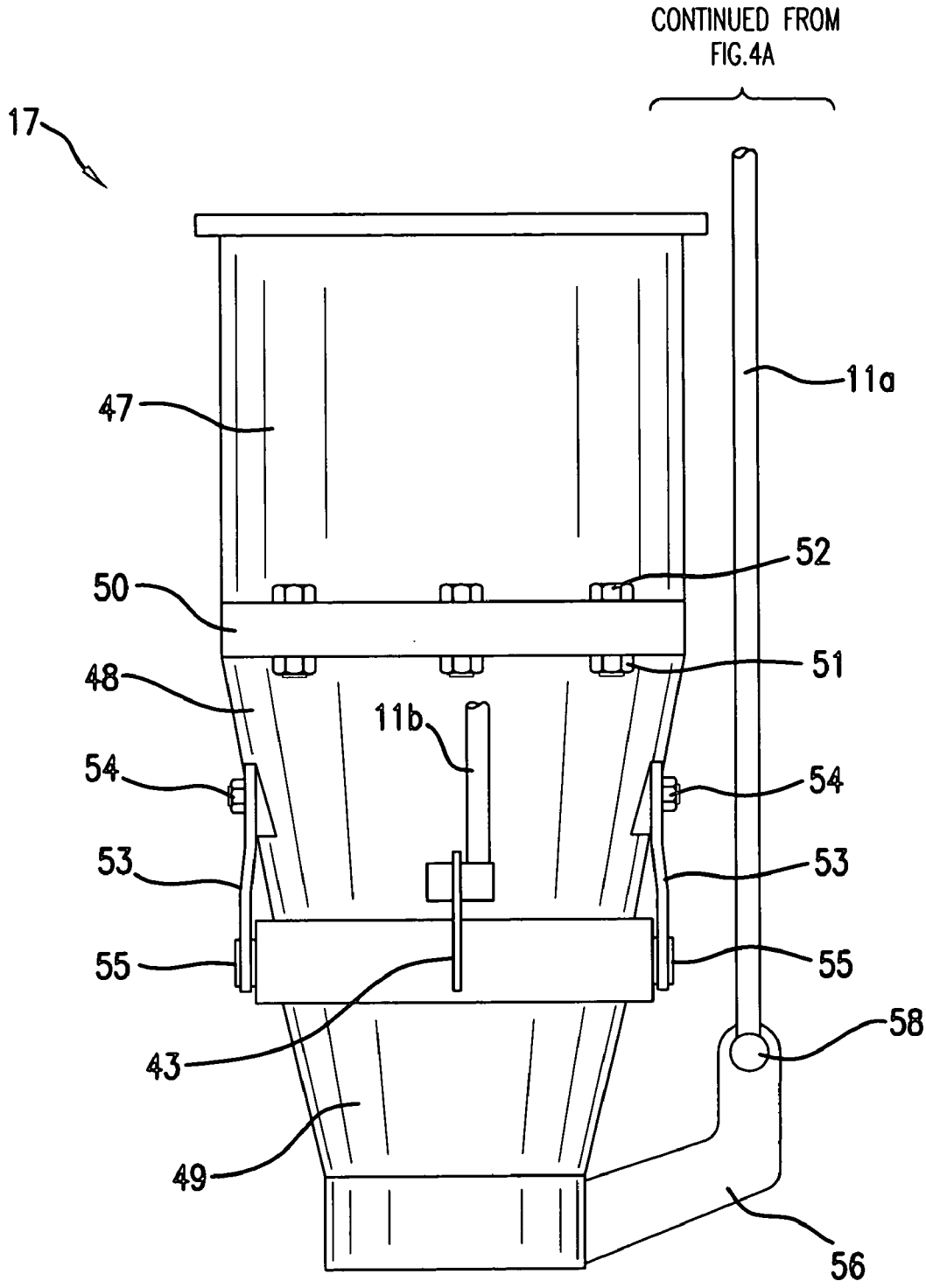
FIG. 4B is a top plan view of an outdrive of a watercraft steering apparatus according to the present invention.

Turning to the outdrive 17 illustrated in FIG. 3B (side elevational view) and FIG. 4B (top plan view), the outdrive 17 is comprised of an intake 47, a pumping unit 48, and a rear nozzle 49. The intake 47 is generally cylindrical in shape and hollow so that water may flow through it. Flanges 50, which extend generally outwardly from the back end of the intake 47 and the front end of the pumping unit 48, abut one another and are coupled together by a plurality of flange bolts 51 and flange nuts 52 to form a watertight seal between the intake 47 and the pumping unit 48. The pumping unit 48 is also generally cylindrical in shape and hollow; however, the pumping unit 48 is gradually tapered from its front end to its back end. The rear nozzle 49 is linked to the pumping unit 48 via outdrive brackets 53. Outdrive bracket screws 54 attach an end of each outdrive bracket 53 to a side of the pumping unit 48 and pivot pins 55 pivotally attach the opposite end of each outdrive bracket 53 to a side of the rear nozzle 49. The outdrive brackets 53 are located diametrically opposite to one another. The rear nozzle 49 is generally cylindrical in shape, hollow, and gradually tapered from its front end to its back end. A first L-shaped arm 43 projects from the top side of the nozzle 49 and a second L-shaped arm 56 projects from a side of the nozzle 49. An impeller (not shown) powered by the boat's engine spins within the pumping unit 48. In general, the impeller sucks water into the intake 47, increases the water's pressure, and discharges the high pressure water from the nozzle 49 to propel the boat forward.

As depicted in FIGS. 3A through 4F, movement of the direction push-pull cable 11*a* and the plane push-pull cable 11*b* via the joystick controls movement of the outdrive 17, which steers the boat and keeps the boat on plane. As seen in FIG. 3A, one end of the plane cable 11*b* is connected to a cable attachment portion 42, which extends from the underside of the second rod 29 at the base of the joystick apparatus 12*a* (see FIG. 4A). The cable end is preferably threaded through a first aperture 40 in the cable attachment portion 42, and tied off. An opposite end of the plane cable 11*b* is connected to the first L-shaped arm 43 of the outdrive 17, preferably by threading the cable end through a second aperture 41 in the first L-shaped arm 43 and tying it off.

As seen in FIG. 4A, one end of the direction cable 11*a* is connected to the second swinging arm 24, preferably by threading it through a fourth aperture 57 in the end of the second swinging arm 24 opposite the connection means 26 and tying it off. An opposite end of the direction cable 11*a* is connected to the second L-shaped arm 56 of the outdrive 17, preferably by threading it through a fifth aperture 58 in the second L-shaped arm 56 and tying it off. From the second swinging arm 24, the tensioned direction cable 11*a* loops around a wheel-type pulley 59. The pulley 59 is mounted on a second bracket 60, which is in turn affixed to the boat. Both cables 11*a*, 11*b* are push-pull type cables.

Pivoting the joystick 12 from the generally vertical, upright, central position shown in FIG. 3A to positions forward of the upright position, also shown in FIG. 3A, controls the orientation of the outdrive 17 in a vertical plane, as shown in FIG. 3B. When the joystick 12 is in the upright, central position, the mechanical housing 13 is also in the upright position. As a result, the rear nozzle 49 of the outdrive 17 is vertically aligned with the intake 47 and the pumping unit 48. Water is forced out of the rear nozzle 49 horizontally backward, which propels the nose of the boat horizontally forward.

When the boat driver pushes the joystick 12 forward, the mechanical housing 13 remains longitudinally oriented with the joystick 12 and is thus forced backward. As a result, the plane cable 11*b* moves the rear nozzle 49 out of horizontal alignment with the intake 47 and the pumping unit 48, shown in FIG. 3B, into a position in which the nozzle 49 is pointed downward. Subsequently, water is forced out of the nozzle 49 in a downward direction, which propels the stern of the boat upward and the bow downward. Thus, the boat driver pushes the joystick 12 forward after starting the boat to get the boat "out of the hole." Once the boat is generally on plane, the boat driver returns the joystick 12 to its upright, generally vertical (steady state) position.

In a preferred embodiment of the watercraft steering apparatus, a second coil spring 44 is attenuated between the first aperture 40 and a third aperture 45 in a first bracket 46, which is connected to a stationary wall of the boat in front of the base of the joystick apparatus. When the boat driver opens his or her hand and releases the joystick 12 from any position forward of the upright, central position, the second coil spring 44 forces the joystick 12 back to the upright, central position. However, the second coil spring 44 is not necessary. In an embodiment of the watercraft steering apparatus without a second coil spring 44, the rear nozzle 49 naturally returns to vertical alignment with the intake 47 and the pumping unit 48 once the boat is on plane. The joystick 12 is forced back to its upright, central position.

Figure 4C:
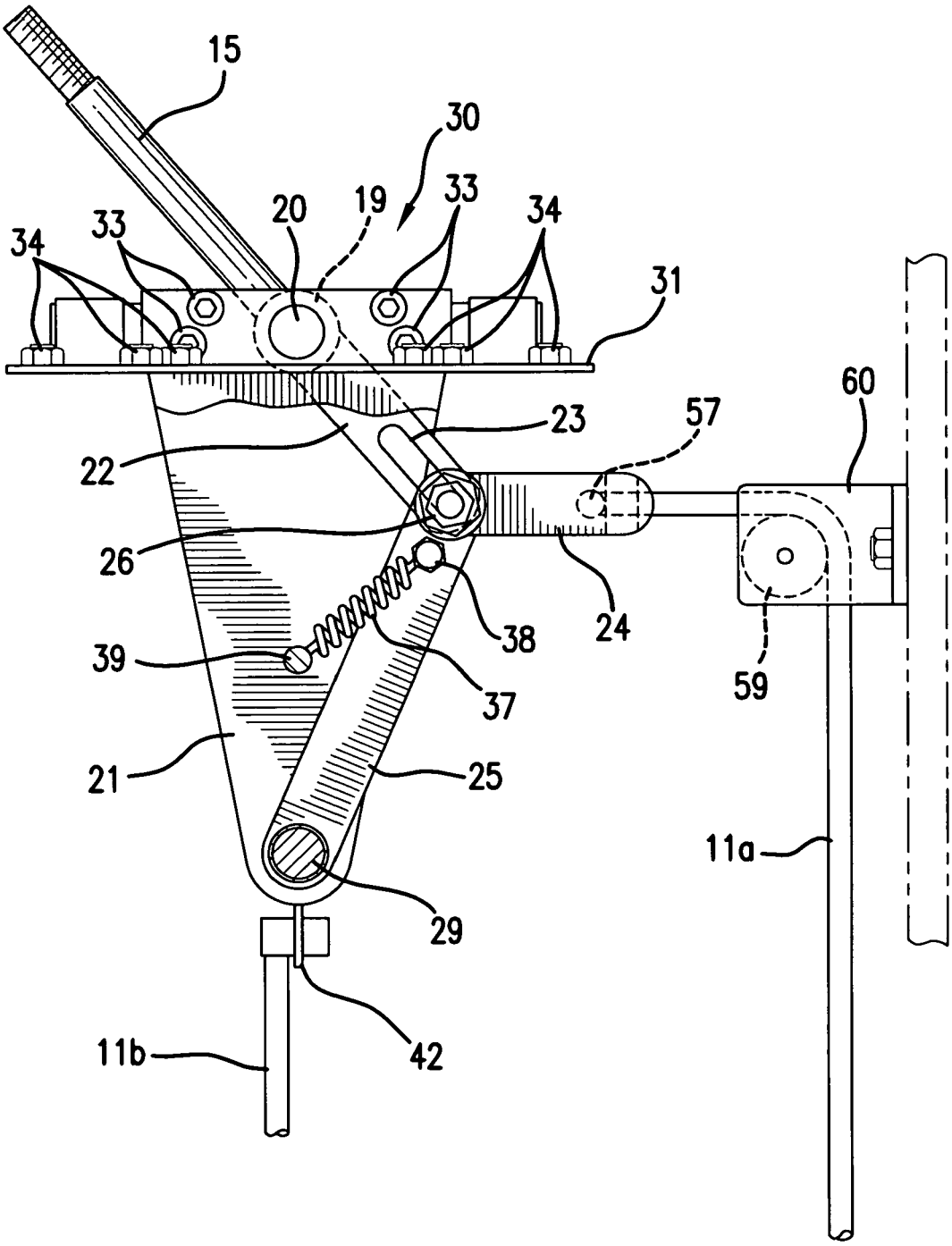
FIG. 4C is a front view of a joystick apparatus according to the present invention, shown in a right steering position and without the first side of the mechanical housing.
Figure 4D:
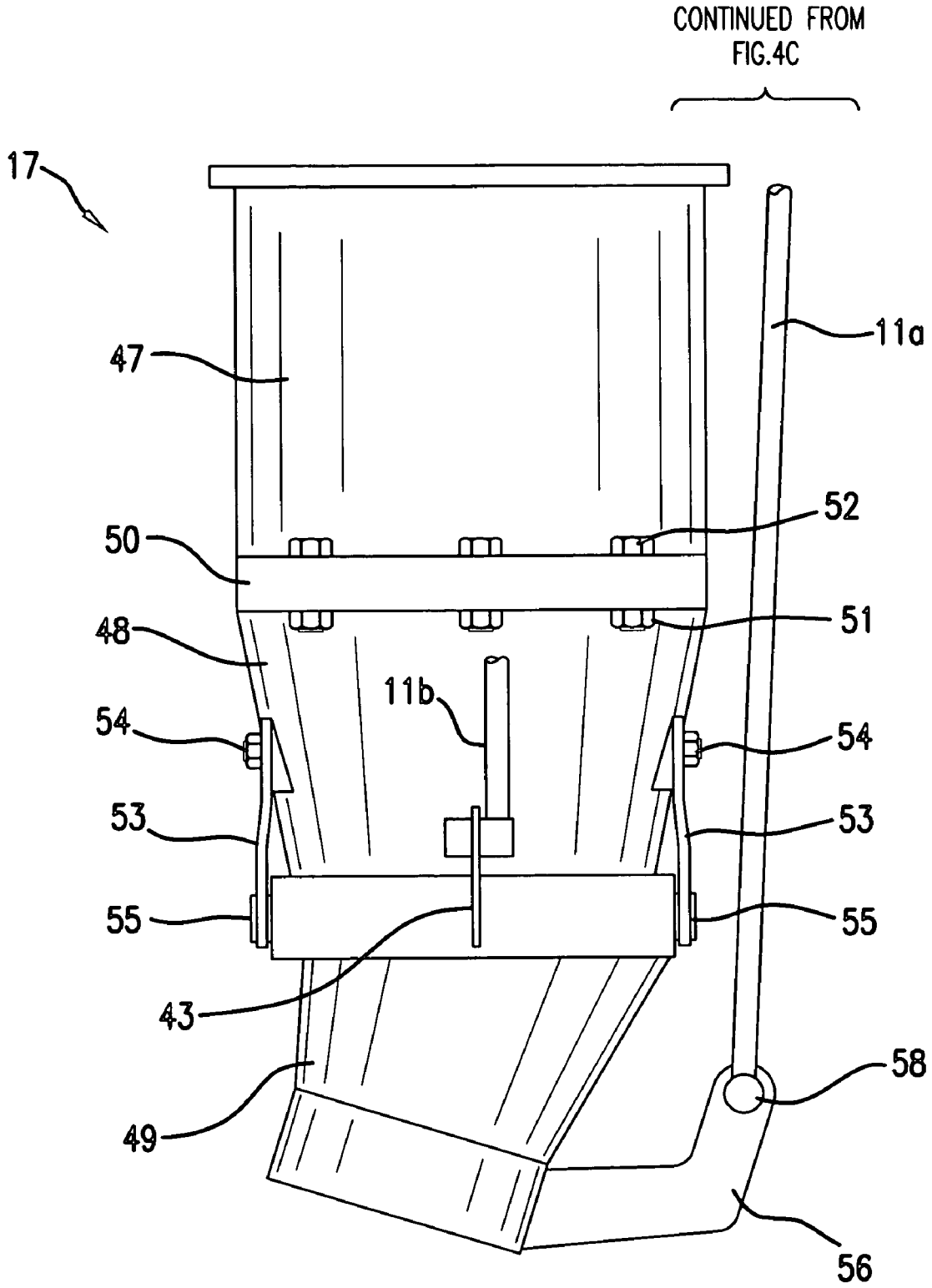
FIG. 4D is a top plan view of an outdrive of a watercraft steering apparatus according to the present invention, showing a nozzle angled left to steer a watercraft right.
Figure 4E:
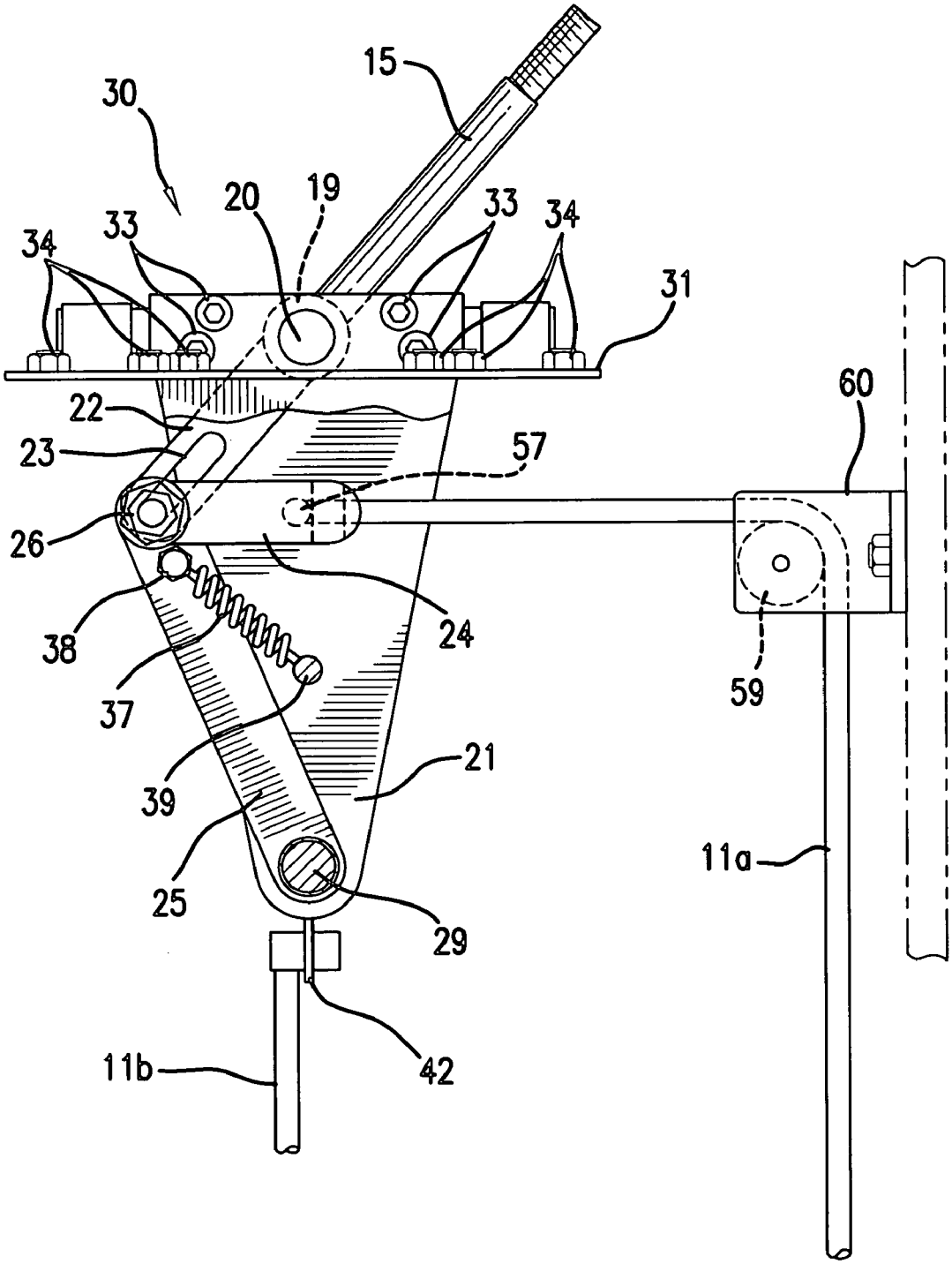
FIG. 4E is a front view of a joystick apparatus according to the present invention, shown in a left steering position and without the first side of the mechanical housing.
Figure 4F:
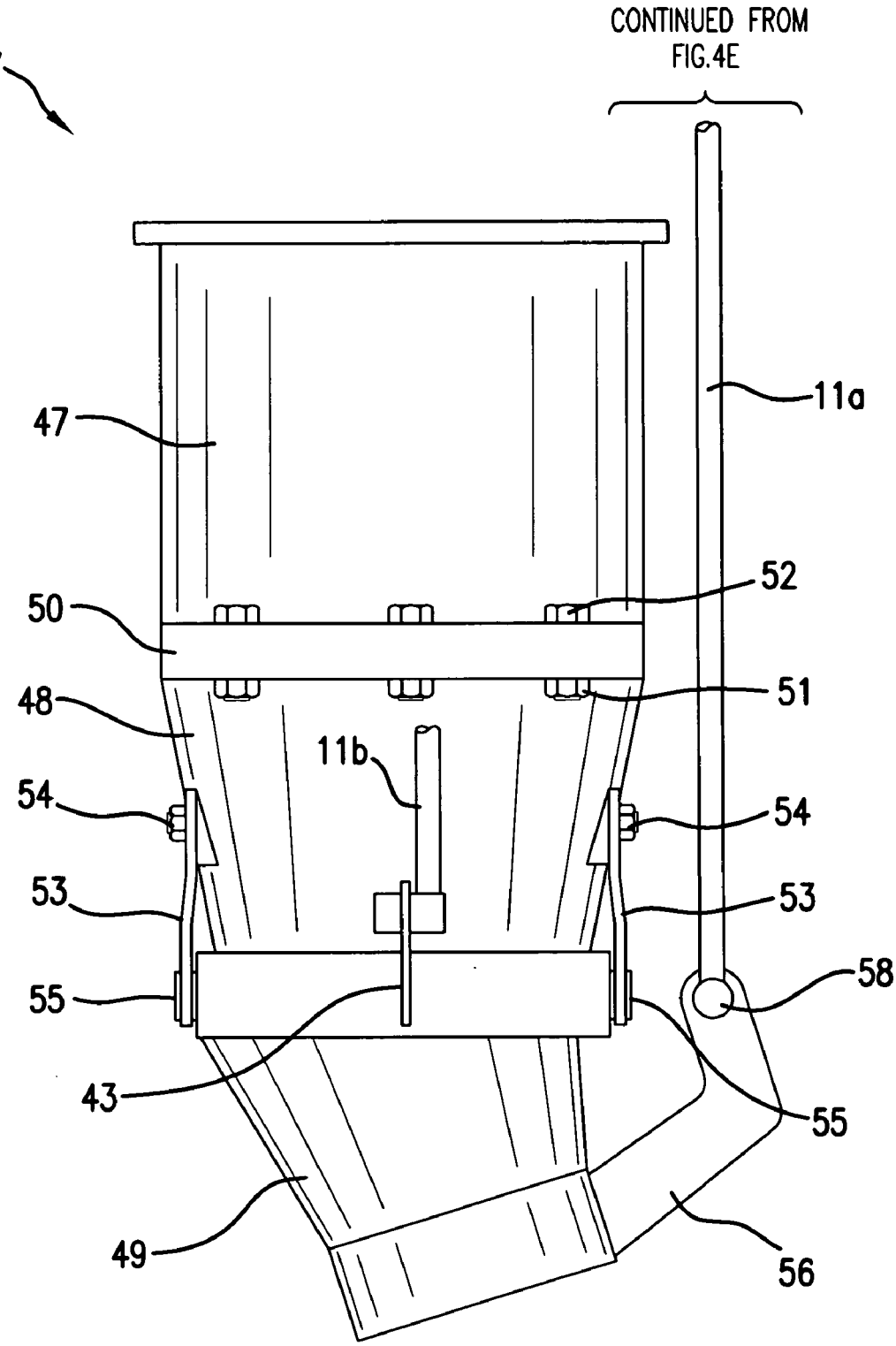
FIG. 4F is a top plan view of an outdrive of a watercraft steering apparatus according to the present invention, showing a nozzle angled right to steer a watercraft left.

Pivoting the joystick 12 from an upright position, shown in FIG. 4A, to positions right of the upright position, shown in FIG. 4C, and positions left of the upright position, shown in FIG. 4E, controls the orientation of the outdrive 17 in a horizontal plane, see FIGS. 4B, 4D, and 4F. When the joystick 12 is in the upright position or a position forward of the upright position, the first swinging arm 22 and the third swinging arm 25 are longitudinally oriented with the joystick 12 and the second swinging arm 24 is substantially perpendicularly oriented to the first swinging arm 22 and the third swinging arm 25. The direction cable 11*a* is positioned such that the rear nozzle 49 is horizontally aligned with the intake 47 and the pumping unit 48. Water is forced out of the nozzle 49 horizontally backward, which propels the boat horizontally forward. Thus, the boat driver keeps the joystick 12 in the upright position to steer the boat straight. The boat also travels in a line when the joystick 12 is in a position forward of the upright position.

When the boat driver pushes the joystick 12 to a position right of the upright position, the connection means 26 travels along the elongate slot 23, and the third swinging arm 25 pivots to the left about the second rod 29 and the connection means 26. The second swinging arm 24 pulls the direction cable 11*a* along the pulley 59, which causes the nozzle 49 to move out of horizontal alignment with the intake 47 and the pumping unit 48 into a position in which the nozzle 49 is pointed rightward. Water is subsequently forced out of the nozzle 49 in a rightward direction, turning the boat to the right. Thus, the boat driver pushes the joystick 12 right of the upright position in order to steer the boat to the driver's right.

When the boat driver pushes the joystick 12 to a position left of the upright position, the connection means 26 travels along the elongate slot 23, and the third swinging arm 25 pivots to the right about the second rod 29 and the connections means 26. The second swinging arm 24 pushes the direction cable 11*a* along the pulley 59, which causes the nozzle 49 to move out of horizontal alignment with the intake 47 and the pumping unit 48 into a position in which the nozzle 49 is pointed leftward. Water is subsequently forced out of the nozzle 49 in a leftward direction, which turns the boat to the left. Thus, the boat driver pushes the joystick 12 left of the upright position in order to steer the boat to the driver's left.

The steering apparatus 10 is designed so the angle created by pivoting the joystick 12 right or left of the upright position approximately equals the angle (e.g., 45 degrees) that the outdrive nozzle 49 pivots right or left from its longitudinal alignment with the intake 47 and the pumping unit 48. Preferably, the joystick 12 does not pivot more than about 45 degrees right or left from the upright position. Similarly, the nozzle 49 preferably does not pivot more than about 45 degrees right or left from longitudinal alignment with the intake 47 and the pumping unit 48.

As mentioned, in a preferred embodiment of the watercraft steering apparatus, the first coil spring 37 is suspended between a stationary side 21 of the mechanical housing 13 and the third swinging arm 25. The first coil spring 37 resists sudden movement of the joystick 12 to the right or left of the upright position. With the first coil spring 37, the boat does not turn as fast when the driver pivots the joystick 12 as it would if the first coil spring 37 were absent and the driver pivoted the joystick 12 with the same force. The first coil spring 37 reduces the boat's responsiveness for the safety of more inexperienced drivers. For racing, where a boat's responsiveness is of utmost importance and the boat drivers are professionals, the first coil spring 37 may be eliminated, which allows the steering apparatus to respond even more quickly.

Also included herein is a method for steering a waterjet propelled watercraft with one hand, comprising the steps of:

(a) depressing the throttle trigger 16;

(b) pushing the joystick 12 forward with the same hand to bring the watercraft substantially on plane;

(c) allowing the joystick 12 to return to a generally vertical position once the watercraft is substantially on plane;

(d) pushing the joystick 12 to a position that is right or left of the generally vertical position to steer the watercraft in a rightward or leftward direction, respectively; and (e) allowing the joystick 12 to return to the generally vertical position once a right or left turn is achieved. The second coil spring 44 may be employed to facilitate return of the joystick 12 to upright, generally vertical position (see FIG. 4A).

Also included herein is a process for manufacturing a joystick steering apparatus for a watercraft having a jet drive engine and an outdrive, comprising the steps of:

(a) attaching the end of the first push-pull cable 11*a* to a connection at the base of the swivelable joystick apparatus 12*a* (see FIG. 3A);

(b) attaching the opposite end of the first push-pull cable 11*a* to the mechanism 43 on the outdrive 17 for moving the nozzle 12 of the outdrive from a center position to a downward position (see FIG. 3B);

(c) attaching the end of the second push-pull cable 11*b* to a movable connection on a horizontally oriented swing arm 24 on the joystick apparatus 12*a*, the horizontally oriented (second) swing arm 24 being movably connected to the joystick 12 (see FIG. 4A); and (d) attaching the opposite end of the second push-pull cable 11*b* to the mechanism 43 on the outdrive 17 for moving the movable rear nozzle 49 of the outdrive 17 to a position that is left or right of center (see FIG. 4B–D);

From the foregoing it can be realized that the described device of the present invention may be easily and conveniently utilized as watercraft steering apparatus. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS

10 watercraft steering apparatus
11*a* first push-pull cable
11*b* second push-pull cable
12*a* joystick apparatus
12 joystick
13 mechanical housing
14 hand grip
15 steering arm
16 throttle trigger
17 outdrive
18 rubber boot
19 pivot rod
20 first rod
21 first side
22 first swinging arm
23 elongate slot
24 second swinging arm
25 third swinging arm
26 connection means
27 nut
28 washer
29 second pivot rod
30 well
31 housing plate
32 second side
33 first bolts
34 second bolts
35 bolt aperture
36 pin holder
37 first coil spring
38 first spring bolt
39 second spring bolt
40 first aperture
41 second aperture
42 cable attachment portion
43 first L-shaped arm
44 second coil spring
45 third aperture
46 first bracket
47 intake
48 pumping unit
49 nozzle
50 flanges
51 flange bolts
52 flange nuts
53 outdrive bracket
54 outdrive bracket screw
55 pivot pin
56 second L-shaped arm
57 fourth aperture
58 fifth aperture
59 pulley
60 second bracket
61 housing plate aperture
62 pin
70 watercraft

What is claimed is:

1. A joystick apparatus for steering a waterjet propelled watercraft, the joystick apparatus comprising:

(a) a joystick comprising at least three movably interconnected swinging arms, with a first and third one of the swinging arms being generally vertically oriented, and a second one of the swinging arms being generally horizontally oriented;

(b) a mechanical housing supporting the joystick, the mechanical housing comprising a generally horizontally oriented housing plate affixed to the watercraft, the joystick passing through an aperture in the housing plate and being swivelable on the housing plate; and (c) at least one mechanism movably connecting the joystick apparatus to an outdrive of the watercraft;

wherein the joystick has at least one forward position for putting the watercraft on plane, at least one alternate, right steering position for steering the watercraft in a rightward direction, and at least one alternate, left steering position for steering the watercraft in a leftward direction.

2. A joystick apparatus according to claim 1, wherein the at least one mechanism connecting the joystick apparatus to an outdrive of the watercraft comprises a movable first push-pull cable connected at one end to a base of the joystick apparatus and operably connected at an opposite end to a mechanism for moving a rear nozzle of the outdrive.

3. A joystick apparatus according to claim 1, wherein the mechanism connecting the joystick apparatus to an outdrive of the watercraft comprises a second push-pull cable connected at one end to the second swinging arm and operably connected at an opposite end to the mechanism for moving a rear nozzle of the outdrive.

4. A joystick apparatus according to claim 1, wherein a bottom portion of the first swinging arm comprises an elongate slot, and the first and third swinging arms are connected substantially end to end.

5. A joystick apparatus according to claim 4, wherein the second and third swinging arms are branched at one end, and matching branches of an upper end of the third swinging arm pivotally straddle a bottom portion of the first swinging arm.

6. A joystick apparatus according to claim 5, wherein end portions of the matching branches of the second swinging arm pivotally straddle upper end portions of the branches of the third swinging arm.

7. A joystick apparatus according to claim 6, wherein the first, second, and third swinging arms pivot about a bolt extending through the elongate slot and through corresponding holes in the branches of the second and third swinging arms.

8. A joystick apparatus according to claim 1, wherein the mechanical housing further comprises two opposite first sides, which extend in a generally vertical direction through a rectangularly shaped housing plate aperture in a generally horizontally oriented housing plate.

9. A joystick apparatus according to claim 8, wherein the mechanical housing further comprises two opposite second sides connected to the two first sides, the first sides being substantially perpendicularly oriented to the second sides, forming a rectangular shaped well.

10. A joystick apparatus according to claim 9, wherein the mechanical housing further comprises at least two opposite, rotatable pins, which protrude substantially perpendicularly from the second sides on the housing plate.

11. A joystick apparatus according to claim 1, which is not hydraulic and does not require electricity to operate it.

12. A joystick apparatus according to claim 9, wherein the joystick comprises an upper hand grip portion affixed to a lower steering arm.

13. A joystick apparatus according to claim 12, further comprising a pivot mechanism between the steering arm above the well and the first swinging arm below the well for pivoting the steering arm and the first swinging arm within the well.

14. A joystick apparatus according to claim 13, wherein the pivot mechanism comprises a hollow, cylindrical pivot rod enclosing a cylindrical first rod, the first rod being supported by the first sides, the pivot rod and the first rod being transversely oriented to the steering arm, the cylindrical pivot rod being rotatable on the first rod.

15. A joystick apparatus according to claim 8, further comprising a first coil spring attenuated between the third swinging arm and the first side of the mechanical housing.

16. A joystick apparatus according to claim 9, further comprising a second pivot rod pivotally connecting a base of the third swinging arm to the opposite first sides of the mechanical housing, the third swinging arm being pivotable on the second pivot rod from an upright, central position to the left and right steering positions.

17. A joystick apparatus according to claim 3, further comprising a second coil spring attenuated between the base of the joystick apparatus and a stationary wall of the boat.

18. A watercraft steering apparatus for a watercraft with a jet drive engine, the steering apparatus comprising:

(a) a joystick apparatus comprising a joystick and a mechanical housing supporting the joystick, the joystick comprising at least three movably interconnected swinging arms, with a first and third one of the swinging arms being generally vertically oriented and connected end to end, and a second one of the swinging arms being generally horizontally oriented;

(b) an outdrive comprising a movable rear nozzle; and (c) at least one cable mechanism operably connecting the joystick apparatus and the nozzle;

wherein movement of the joystick causes the nozzle to move a corresponding distance, and, when the watercraft engine is on and water is passing through the outdrive, this movement of the nozzle alters the direction of travel of the watercraft.

19. A watercraft steering apparatus according to claim 18, wherein the at least one cable mechanism operably connecting the joystick apparatus and the nozzle is a first push-pull cable connected at one end to the base of the joystick apparatus and operably connected at an opposite end to a movable rear nozzle of the outdrive.

20. A watercraft steering apparatus according to claim 19, wherein the cable mechanism connecting the joystick apparatus to an outdrive of the watercraft further comprises a second push-pull cable connected at one end to the second swinging arm and operably connected at an opposite end to a movable rear nozzle of the outdrive.

21. A method for steering a waterjet propelled watercraft with one hand, the method comprising the steps of:

(a) depressing a throttle trigger of a joystick;

(b) pushing the joystick forward with the same hand to bring the watercraft substantially on plane;

(c) allowing the joystick to return to a generally vertical position once the watercraft is substantially on plane;

(d) pushing the joystick to a position that is right or left of the generally vertical, center position to steer the watercraft in a rightward or leftward direction, respectively; and (e) allowing the joystick to return to the generally vertical position once a right or left turn is achieved.

22. A process for manufacturing a joystick steering apparatus for a watercraft having a jet drive engine and an outdrive, the process comprising the steps of:

(a) attaching an end of a first push-pull cable to a connection at the base of a swivelable joystick apparatus;

(b) attaching an opposite end of the first push-pull cable to a mechanism on the outdrive for moving a nozzle of the outdrive from a center position to a downward position;

(c) attaching an end of a second push-pull cable to a movable connection on a horizontally oriented swing arm on a joystick apparatus, the horizontally oriented swing arm being movably connected to a joystick of the joystick apparatus; and (d) attaching an opposite end of the second push-pull cable to a mechanism on the outdrive for moving a movable rear nozzle of the outdrive to a position that is left or right of center.

* * * * *